US006359545B1

(12) United States Patent
Bressers

(10) Patent No.: US 6,359,545 B1
(45) Date of Patent: Mar. 19, 2002

(54) ADJUSTABLE RESISTOR WITH SLIDER MADE FROM ELASTOMERIC MATERIAL

(75) Inventor: Cornelius G. Bressers, Bergeijk (NL)

(73) Assignee: Capax B.V., Einhoven (NL)

( * ) Notice: Subject to any disclaimer, the term of this patent is extended or adjusted under 35 U.S.C. 154(b) by 0 days.

(21) Appl. No.: 09/582,862

(22) PCT Filed: Jan. 9, 1998

(86) PCT No.: PCT/NL98/00020

§ 371 Date: Mar. 7, 2001

§ 102(e) Date: Mar. 7, 2001

(87) PCT Pub. No.: WO99/35654

PCT Pub. Date: Jul. 15, 1999

(51) Int. Cl.[7] ..... H01C 10/30
(52) U.S. Cl. ..... 338/160; 338/162
(58) Field of Search ..... 338/160, 161, 338/162, 165, 176

(56) References Cited

U.S. PATENT DOCUMENTS

| | | | | |
|---|---|---|---|---|
| 4,045,765 A | * | 8/1977 | Imamura | 338/176 |
| 4,426,634 A | * | 1/1984 | Okuya et al. | 338/161 |
| 4,435,691 A | * | 3/1984 | Ginn | 338/125 |
| 4,504,818 A | * | 3/1985 | Okuya et al. | 338/119 |
| 4,771,263 A | * | 9/1988 | Crook et al. | 338/176 |
| 4,833,440 A | * | 5/1989 | Wojtanek | 338/114 |
| 5,422,452 A | | 6/1995 | Chang et al. | |
| 5,554,965 A | * | 9/1996 | Sundberg | 338/160 |

FOREIGN PATENT DOCUMENTS

| | | |
|---|---|---|
| EP | 0076039 | 4/1983 |

OTHER PUBLICATIONS

Pat. Abst. of Japan vol. 096, No. 009 (Sep. 30, 1996) (JP 08 124722 May 17, 1996).

* cited by examiner

*Primary Examiner*—Karl D. Easthom
*Assistant Examiner*—Kyung S. Lee
(74) *Attorney, Agent, or Firm*—Banner & Witcoff Ltd.

(57) ABSTRACT

The invention relates to an adjustable resistor comprising a strip of resistance material arranged on an insulating carrier and a slider made of conductive material guidable along the strip and contacting the strip, wherein the slider is manufactured from elastomeric material. A slider manufactured from an elastomeric material will, as a result of its flexibility, make contact with the resistance strip over a relatively large part of the width of the resistance strip so flat the problems of an uneven current distribution associated with one-point contact are avoided. The use of an elastomeric material further provides the option of dimensioning and shaping the slider such that it can be handled easily by means of a positioning machine, and the problems of the usually elongate rigid sliders on the production line are avoided. The slider is preferably manufactured from conductive rubber or a conductive plastic. According to yet another embodiment the slider is clamped in a carriage movable parallel to the strip.

17 Claims, 2 Drawing Sheets

ADJUSTABLE RESISTOR WITH SLIDER MADE FROM ELASTOMERIC MATERIAL

FIELD OF THE INVENTION

The present invention relates to an adjustable resistor comprising a strip of resistance material arranged on an insulating carrier and a slider made of conductive material movable along the strip and contacting the strip.

BACKGROUND OF THE INVENTION

Such adjustable resistors are generally known, for instance in the form of potentiometers, wherein the slider is formed by an element usually made of copper or silver which is movable along a carbon strip. Such adjustable resistors are also known in the form of for instance ceramic printed circuit boards on which strips of resistance material are arranged along which a slider made of copper or silver is movable and which can be used in particular to adjust the speed of an electrical hand-tool. In both cases a slider of a rigid, though slightly resilient material is moved along a resistance strip. The resilience of the material is necessary herein to press a contact surface of the slider against the resistance strip.

It is noted here that while such a material is resilient, it is hardly flexible. This has the consequence that generally only one point of the slider is in contact with the resistance strip. A current can thus flow only at this one point between the slider and the resistance strip. The current flowing through the resistance strip to the slider will, starting from one end of the resistance strip, initially be fully distributed over the width of the resistance strip, but in the vicinity of the contact position of the slider will be distributed with a greater current density to this contact position. This results in an uneven current distribution and thus to a locally higher current density and a locally greater resistance. The curve of the adjustable resistor is thus not linear. This problem otherwise occurs both when the adjustable resistor is used purely as an adjustable resistor and when it is used as a potentiometer. In the case of a potentiometer, a current flowing from the one end of the resistance strip to the other end of the resistance strip is superimposed on the said current.

U.S. Pat. No. 4,833,440 provides an adjustable resistor comprising a strip of resistance material arranged on an insulating carrier and a slider made of conductive material guidable along the strip and contacting the strip, wherein the slider is manufactured from elastomeric material.

This prior art resistor avoids the problems mentioned above.

However, this prior art resistor has the draw back that an uneven distribution of the current is created through the cross-section of the resistance strip in the vincinity of the slider, when the contact surface between the resistance strip and the slider does not extend over the resistance strip.

BRIEF DESCRIPTION OF THE INVENTION

The present invention aims to provide such a resistor, wherein this problem is avoided.

This aim is reached in that the resistance strip is divided into two parallel extending strips of equal width, and that the contact surface of the slider is interrupted and that each of the thus formed parts of the contact surface makes contact with one of the strips.

The problems associated with the prior art are avoided by the configuration of the two resistance strips. The resistance cannot become smaller between the two sliders than the resistance of the fixed connection there between.

A slider manufactured from an elastomeric material will, as a result of its flexibility, make contact with the resistance strip over a relatively large part of the width of the resistance strip, so that the problems of an uneven current distribution associated with one-point contact are avoided.

The use of an elastomeric material further provides the option of dimensioning and shaping the slider such that it can be handled easily by means of a positioning machine, and the problems of the usually elongate rigid sliders on the production line are avoided.

The slider is preferably manufactured from conductive rubber or a conductive plastic. According to yet another embodiment the slider is clamped in a carriage movable parallel to the strip.

BRIEF DESCRIPTION OF THE DRAWINGS

The present invention will be elucidated hereinbelow with reference to the annexed drawings, in which.

DETAILED DESCRIPTION OF THE INVENTION

Figure 1:
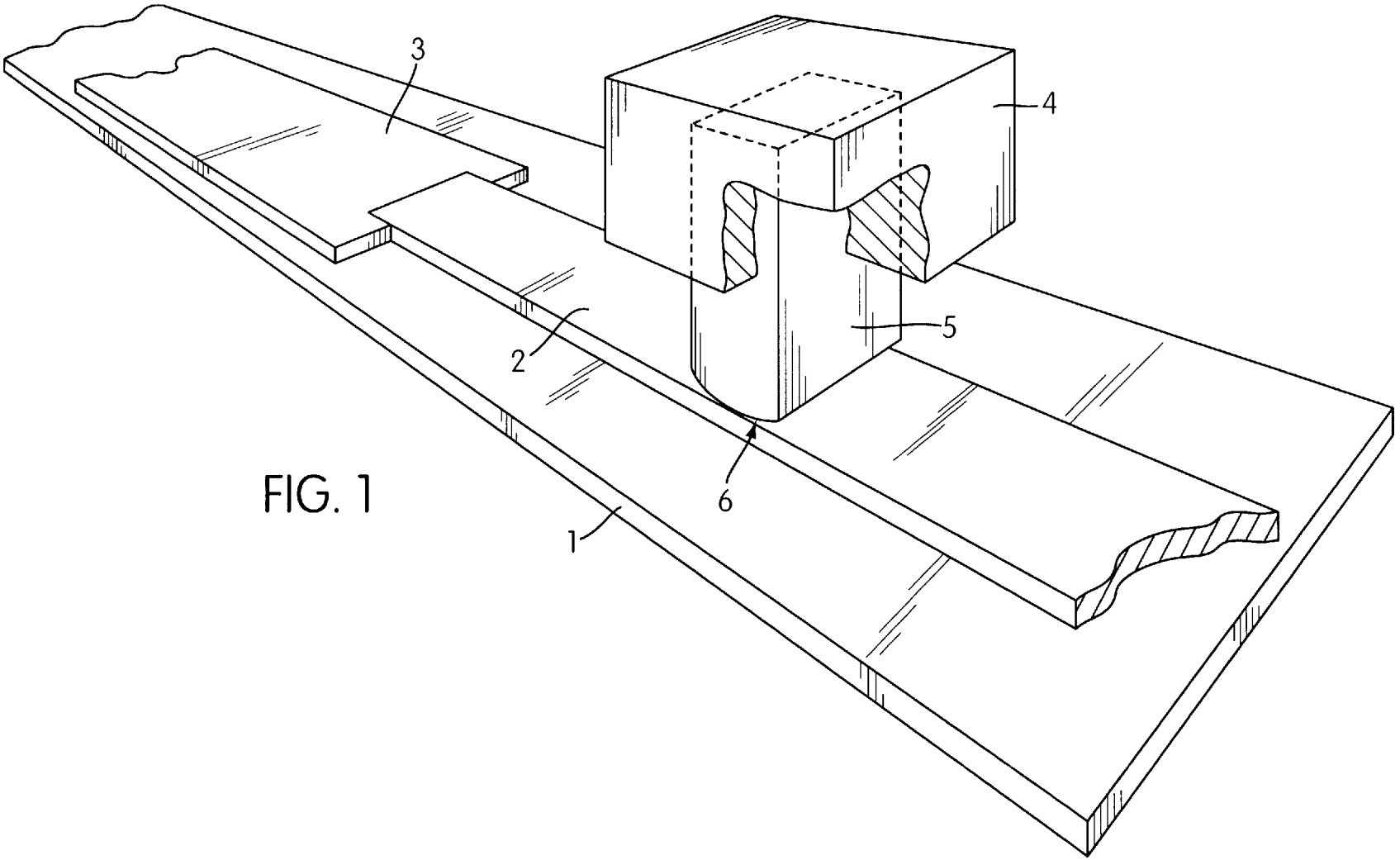
FIG. 1 shows a schematic perspective view of a first embodiment of an adjustable resistor according to the present invention.

FIG. 1 shows a base plate 1 which is manufactured from insulating material, for instance from ceramic insulating material. This support plate serves as carrier for the components arranged thereon which, in addition to a resistance strip 2 arranged thereon, generally also include other elements such as semiconductors. Such a carrier usually forms part of control electronics for adjusting the rotation speed and/or the torque of electrically driven hand-tools in which such a support plate is arranged.

As stated, a strip 2 of resistance material is arranged on support plate 1 This resistance material is formed by a material which includes conductive particles, for instance carbon, and the specific resistance of which has a value such that the total resistance of the strip acquires the required value. On at least one side the resistance strip 2 is connected to a conductive strip 3 manufactured from conductive material, for instance of copper or of silver. This strip forms the connection to the other components of the circuit in question. In some cases the other side of the resistance strip is likewise connected to the electronic circuit so that a potentiometer-like configuration is obtained. This is not usually the case however. Above support plate 1 is arranged a carriage 4 which is movable parallel to resistance strip 2 by means of guide means, for instance rails, not shown in the drawing.

The carriage 4 is usually connected to an element movable separately in the relevant direction, for instance the trigger of a switch. Carriage 4 has a sleeve form, wherein a slider 5 according to the invention is arranged in the hollow interior of the sleeve. This slider is manufactured according to the invention from elastomeric material. Slider 5 has dimensions such that on its underside the slider contacts the resistance strip 2, Slider 5 is herein provided on its underside with a contact surface 6 which is slightly curved in the plane parallel to the direction of movement and perpendicularly of the strip.

As stated, the slider is manufactured from conductive elastomeric material, for instance rubber. Conductive rubber is a type of rubber which has acquired a certain degree of conductivity through the addition of conductive particles. The resistance will of course be higher than that of the usual sliders made of copper or silver, but in view of the slightly larger dimensions and the larger cross-section of the slider material this is generally no problem. The electronics can moreover compensate the effects thereof.

In the above stated embodiment the width of the contact surface 6 of the slider is the same as or slightly larger than the width of resistance strip 2. Assuming that the resistance of the resistance strip is distributed linearly, a linear resistance change is detected during reciprocal movement of the slider.

Figure 2:
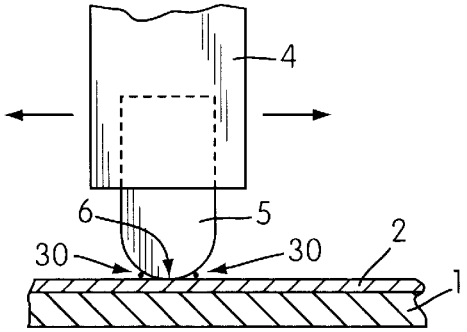
FIG. 2 shows a sectional view of the adjustable resistor depicted in FIG. 1.

Various aspects are shown in cross-section in FIG. 2.

Figure 3:
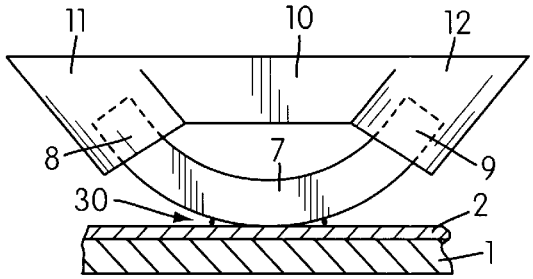
FIG. 3 shows a sectional view of a variant of the adjustable resistor depicted in FIGS. 1 and 2.

FIG. 3 shows an embodiment which has a curved slider 7 which is clamped at both its ends 8,9 in sleeves 11,12 arranged on a carriage 10. Here also is a curved contact surface which, however, corresponds with the side surface of the slider and not with the end surface.

Figure 4:
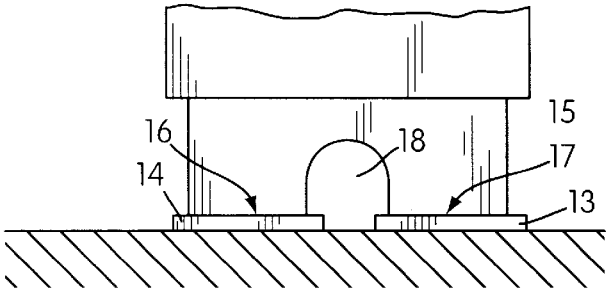
FIG. 4 shows a sectional view of a second variant of an adjustable resistor according to the invention.
Figure 5:
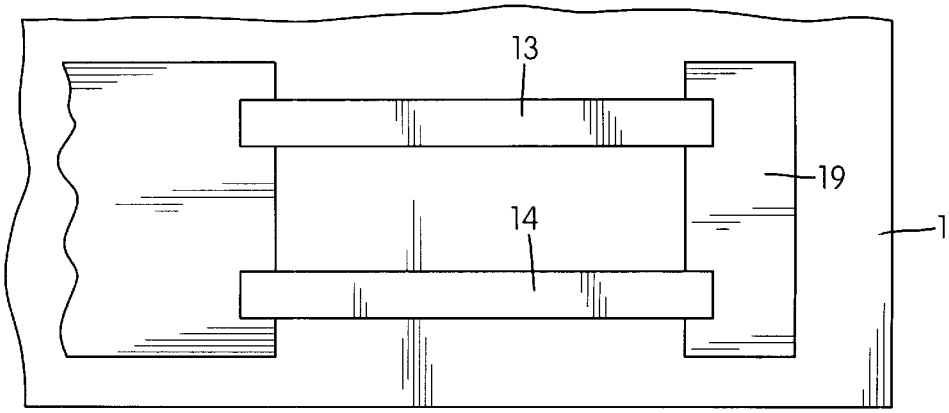
FIG. 5 is a top view of resistance strips of the variant shown in FIG. 4.

Shown in FIG. 4 is an embodiment wherein there are two separate resistance strips 13,14, as is also shown in FIG. 5. Slider 15 is therefore provided with two separate contact surfaces 16 respectively 17 which are in contact with the associated resistance strip. Slider 15 is provided for this purpose with a cut-away portion 18. This embodiment otherwise corresponds with the embodiment shown in FIGS. 1 and 2.

As Shown in FIG. 5, the two resistance strips are mutually connected on one end by means of a conductive path 19. The two resistance strips 13,14 are connected in parallel by this configuration. Such a configuration is particularly advantageous when the contact surface between resistance strip and slider does not extend over the full length of the resistance strip. In such a situation an uneven distribution of the current is created through the cross-section of the resistance strip in the vicinity of the slider, this being expressed in the form of an increase in resistance. This increase in resistance is particularly noticeable when the slider is situated in the vicinity of one of the ends of the strip. The problems associated herewith are avoided by the configuration of two resistance strips. The resistance cannot become smaller between the two sliders than the resistance of the fixed connection therebetween.

As shown in FIGS. 2 and 3, a layer of lubricant 30 (not necessarily shown to scale) may cover the contact surface of a slider 5 or 7.

It will be apparent that it is possible to deviate in various ways from the shown embodiments without departing from the inventive concept. It is thus possible for instance to apply the invention on single potentiometers, for instance multilayer potentiometers. These multilayer potentiometers generally have a great accuracy which is reduced by the effect of the one-point contact with the slider. This inaccuracy is avoided by using a slider made from an elastomeric material which extends over a substantial part of the width of the resistance strip.

What is claimed is:

1. An adjustable resistor, comprising resistance material arranged on an insulating carrier, said resistance material divided into two parallel extending strips of equal width, and a slider, wherein said slider comprises conductive elastomeric material having an interrupted portion forming two contact surfaces, said slider is guidable along the strips with each contact surface contacting one of the strips, and said strips and said slider are configured so as to form resistors in electrical parallel.

2. An adjustable resistor as claimed in claim 1, wherein said conductive elastomeric material is conductive rubber or conductive plastic.

3. An adjustable resistor as claimed in claim 2, wherein the slider is clamped into a carriage movable parallel to the strips.

4. An adjustable resistor as claimed in claim 2, wherein at least one of said contact surfaces makes contact with one of the strips over the strip's full width.

5. An adjustable resistor as claimed in claim 1, wherein the slider is clamped into a carriage movable parallel to the strips.

6. An adjustable resistor as claimed in claim 5, wherein the carriage comprises a sleeve enclosing the slider and in which an end of the slider is fixedly clamped.

7. An adjustable resistor as claimed in claim 5, wherein at least one of said contact surfaces makes contact with one of the strips over the strip's full width.

8. An adjustable resistor as claimed in claim 5, wherein the strips include ends and are mutually connected on at least one pair of their ends.

9. An adjustable resistor as claimed in claim 5, wherein the adjustable resistor forms part of a circuit for adjusting the rotation speed of an electrical hand-tool.

10. An adjustable resistor as claimed in claim 1, wherein at least one of said contact surfaces makes contact with one of the strips over the strip's full width.

11. An adjustable resistor as claimed in claim 10, wherein the strips include ends and are mutually connected on at least one pair of their ends.

12. An adjustable resistor as claimed in claim 10, wherein the adjustable resistor forms part of a circuit for adjusting the rotation speed of an electrical hand-tool.

13. An adjustable resistor as claimed in claim 1, wherein at least one of the contact surfaces is rounded.

14. An adjustable resistor as claimed in claim 1, wherein the strips include ends and are mutually connected on at least one pair of their ends.

15. An adjustable resistor as claimed in claim 14, wherein the adjustable resistor forms part of a circuit for adjusting the rotation speed of an electrical hand-tool.

16. An adjustable resistor as claimed in claim 1, wherein the adjustable resistor forms part of a circuit for adjusting the rotation speed of an electrical hand-tool.

17. An adjustable resistor as claimed in claim 1, wherein a lubricant layer covers at least one contact surface.

* * * * *